US008388113B2

(12) United States Patent
Park et al.

(10) Patent No.: US 8,388,113 B2
(45) Date of Patent: Mar. 5, 2013

(54) INKJET PRINTHEAD AND METHOD OF MANUFACTURING THE SAME

(75) Inventors: Sung-joon Park, Suwon-si (KR); Myong-jong Kwon, Suwon-si (KR); Kyong-il Kim, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1152 days.

(21) Appl. No.: 12/036,333

(22) Filed: Feb. 25, 2008

(65) Prior Publication Data

US 2009/0058952 A1 Mar. 5, 2009

(30) Foreign Application Priority Data

Aug. 27, 2007 (KR) ..... 10-2007-0086277

(51) Int. Cl.
*B41J 2/05* (2006.01)

(52) U.S. Cl. ..... 347/63

(58) Field of Classification Search ..... 347/63
See application file for complete search history.

(56) References Cited

U.S. PATENT DOCUMENTS

| | | | | |
|---|---|---|---|---|
| 5,212,496 | A | 5/1993 | Badesha et al. | |
| 6,652,091 | B2 * | 11/2003 | Tanno | 347/104 |
| 6,739,519 | B2 | 5/2004 | Stout et al. | |
| 7,256,248 | B2 | 8/2007 | Sugo | |

FOREIGN PATENT DOCUMENTS

| | | |
|---|---|---|
| KR | 1020040021544 | 3/2004 |
| KR | 1020040054430 | 6/2004 |
| KR | 1020070040083 | 4/2007 |

OTHER PUBLICATIONS

Korean Office Action Issued on Jun. 13, 2012 in KR Patent Application No. 10-2007-0086277.

* cited by examiner

*Primary Examiner* — Jerry Rahll
(74) *Attorney, Agent, or Firm* — Stanzione & Kim, LLP

(57) ABSTRACT

Provided are an inkjet printhead and a method of manufacturing the same. The inkjet printhead includes: a substrate, on which a plurality of heaters for heating ink to generated ink bubbles are formed; a chamber layer including a plurality of ink chambers formed on the substrate; and a nozzle layer including a plurality of nozzles formed on the chamber layer. In addition, at least one of the chamber layer and the nozzle layer is formed of an imide silicone resin.

12 Claims, 5 Drawing Sheets

INKJET PRINTHEAD AND METHOD OF MANUFACTURING THE SAME

CROSS-REFERENCE TO RELATED APPLICATIONS

This application claims priority under 35 U.S.C. §119(a) from Korean Patent Application No. 10-2007-0086277, filed on Aug. 27, 2007, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to a thermal inkjet printhead having a chamber layer and a nozzle layer that are formed of improved materials and a method of manufacturing the inkjet printhead.

2. Description of the Related Art

Inkjet printheads are apparatuses for forming images by ejecting fine droplets of ink onto desired positions of a printing medium. Generally, there are two kinds inkjet printheads having different mechanisms for ejecting ink droplets. One is a thermal inkjet printhead that ejects the ink droplets using an expanding force of bubbles after bubbles have been generated in the ink using a thermal source, and the other one is a piezoelectric inkjet printhead that ejects the ink droplets using a pressure applied to the ink, which is caused by a deformation of a piezoelectric material.

The ink ejecting mechanism of the thermal inkjet printhead will be described in more detail as follows. When pulse current flows on a heater that is formed of a heating resistive element, the heater generates heat, and thus, the ink adjacent to the heater is heated instantly to a temperature of about 300° C. Accordingly, the ink boils and generates bubbles, and the generated bubbles expand to press ink filled in an ink chamber. Therefore, the ink around nozzles is ejected out of the ink chamber through the nozzles in the shape of droplets.

The thermal inkjet printhead includes a structure of sequentially stacked chamber and nozzle layers on a substrate, on which heaters are formed. The chamber layer includes a plurality of ink chambers, in which the ink to be ejected is filled, and the nozzle layer includes a plurality of nozzles ejecting the ink. According to the conventional art, the chamber layer is formed by stacking a dry film resist on the substrate and patterning the stacked dry film resist. In addition, the nozzle layer is formed by thermally compressing a plated nickel or polyimide on the chamber layer. Meanwhile, a technology of manufacturing the chamber layer and the nozzle layer through a single process by using a photosensitive epoxy has been developed recently.

SUMMARY OF THE INVENTION

The present general inventive concept provides a thermal inkjet printhead having a chamber layer and a nozzle layer formed of an improved material, and a method of manufacturing the inkjet printhead.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet printhead including a substrate, on which a plurality of heaters to heat ink to generate ink bubbles are formed, a chamber layer including a plurality of ink chambers formed on the substrate, and a nozzle layer including a plurality of nozzles formed on the chamber layer, wherein at least one of the chamber layer and the nozzle layer is formed of an imide silicone resin.

A glue layer may be further formed between the substrate and the chamber layer. The glue layer may be formed of the imide silicone resin.

The chamber layer may have a thickness of 10 to 25 μm. The nozzle layer may have a thickness of 10 to 20 μm.

The substrate may include an ink feed hole that penetrates through the substrate to supply the ink to the ink chambers.

An insulating layer, the heaters, electrodes to supply electric current to the heaters, and a passivation layer to protect the heaters and the electrodes may be sequentially formed on the substrate. An anti-cavitation layer to protect the heaters from a cavitation pressure that is generated when bubbles collapse may be further formed on the passivation layer.

The foregoing and/or other aspects and utilities of the present general inventive concept may also be achieved by providing a method of manufacturing an inkjet printhead, the method including forming a plurality of material layers including a plurality of heaters on a substrate, forming a chamber layer including a plurality of ink chambers on the substrate on which the plurality of material layers are formed, forming a nozzle layer having a plurality of nozzles on the chamber layer; and forming an ink feed hole for supplying ink to the ink chambers in the substrate, wherein at least one of the chamber layer and the nozzle layer is formed of an imide silicone resin.

The method may further include forming a glue layer on the substrate on which the plurality of material layers are formed, before forming the chamber layer. The glue layer may be formed of imide silicone resin.

The forming of the chamber layer may include applying a liquid imide silicone resin on the substrate on which the plurality of material layers are formed, and drying the applied liquid imide silicone resin, patterning the dried imide silicone resin to form the ink chambers; and thermally curing the patterned imide silicone resin. The liquid imide silicone resin may have a viscosity of about 800 to 1600 centi-poise. The patterned imide silicone resin may be thermally cured at a temperature of 300° C. or lower.

The method may further include forming a trench that exposes an upper surface of the substrate by sequentially etching the passivation layer and the insulating layer, and forming a sacrificial layer that fills the trench and the ink chambers, after forming the chamber layer. The method may further include flattening upper surfaces of the sacrificial layer and the chamber layer after forming the sacrificial layer.

The forming of the nozzle layer may include applying a liquid imide silicone resin on the sacrificial layer and the chamber layer, drying the liquid imide silicone resin, patterning the dried imide silicone resin to form the nozzles, and thermally curing the patterned imide silicone resin.

The forming of the ink feed hole may include etching a lower surface of the substrate until the sacrificial layer filled in the trench is exposed, and removing the sacrificial layer filled in the ink chambers and the trench.

The foregoing and/or other aspects and utilities of the present general inventive concept may also be achieved by providing an image forming apparatus including a feeding unit to feed a printing medium, a printing unit to print the printing medium, and having an inkjet printhead having a substrate formed with a plurality of heaters to heat ink to generate ink bubbles, a chamber layer formed on the substrate to define a plurality of ink chambers, and a nozzle layer formed on the chamber layer to define a plurality of nozzles, wherein at least one of the chamber layer and the nozzle layer is formed of an imide silicone resin, and a discharge unit to discharge the printing medium.

The foregoing and/or other aspects and utilities of the present general inventive concept may also be achieved by providing an inkjet printhead including a substrate formed with a plurality of heaters to heat ink to generate ink bubbles, a chamber layer formed on the substrate to define a plurality of ink chambers, a nozzle layer formed on the chamber layer to define a plurality of nozzles, and a glue layer formed between the substrate and the chamber layer and made of an imide silicone resin.

The foregoing and/or other aspects and utilities of the present general inventive concept may also be achieved by providing an inkjet printhead including a substrate formed with a plurality of heaters to heat ink to generate ink bubbles, a chamber layer formed on the substrate and made of a first imide silicone resin to define a plurality of ink chambers, a nozzle layer formed on the chamber layer and made of a second imide silicone resin to define a plurality of nozzles, and a glue layer formed between the substrate and the chamber layer and made of a third imide silicone resin.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
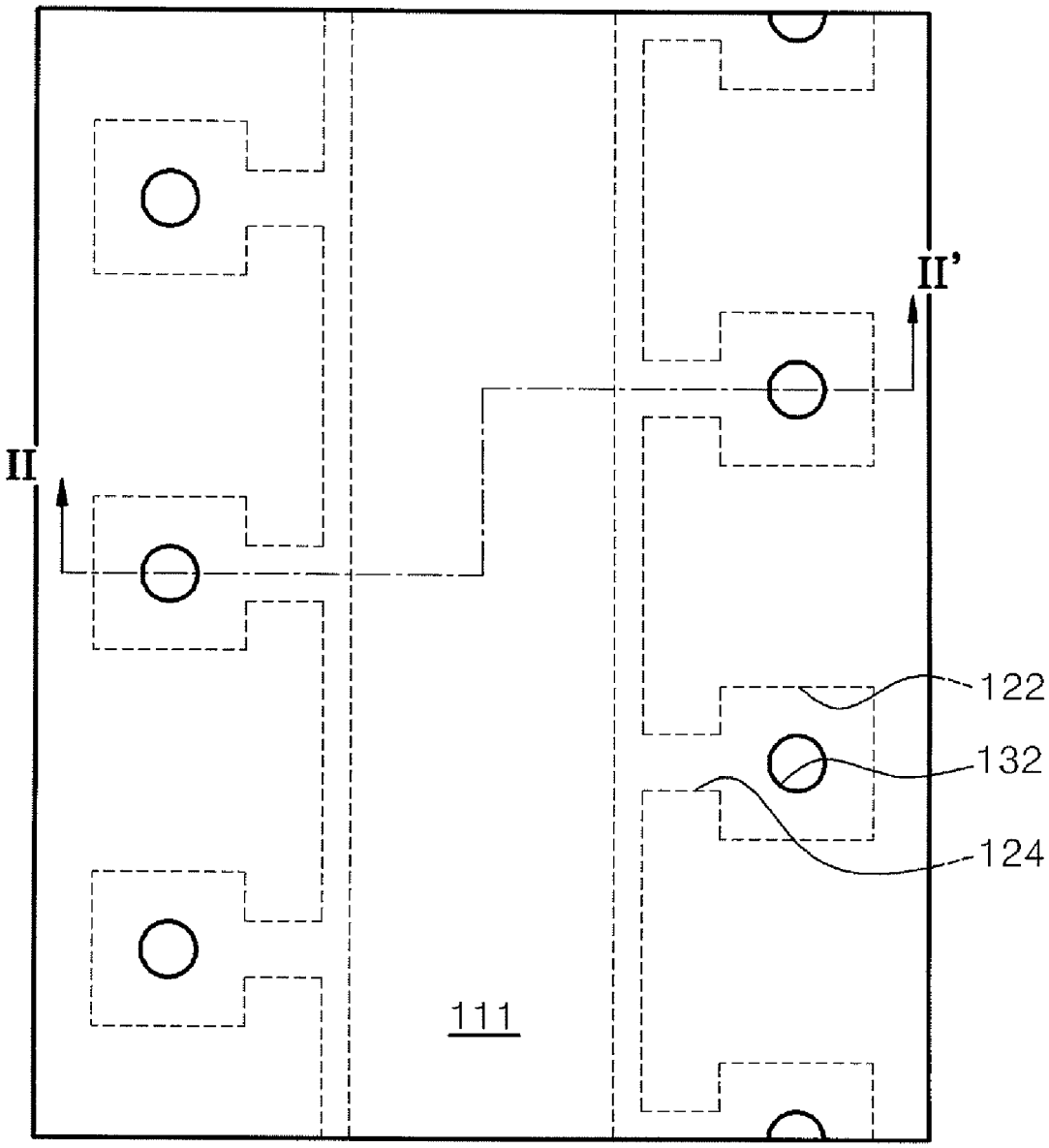
FIG. 1 is a schematic plan view illustrating a thermal inkjet printhead according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. It will be understood that when a layer is referred to as being "on" another layer or substrate, it can be directly on the other layer or substrate, or intervening layers may also be present. In addition, each of the elements in the inkjet in the inkjet printhead can use different materials from the material that is described herein as an example, and an order of processes in the method of manufacturing the inkjet printhead can be varied.

Figure 2:
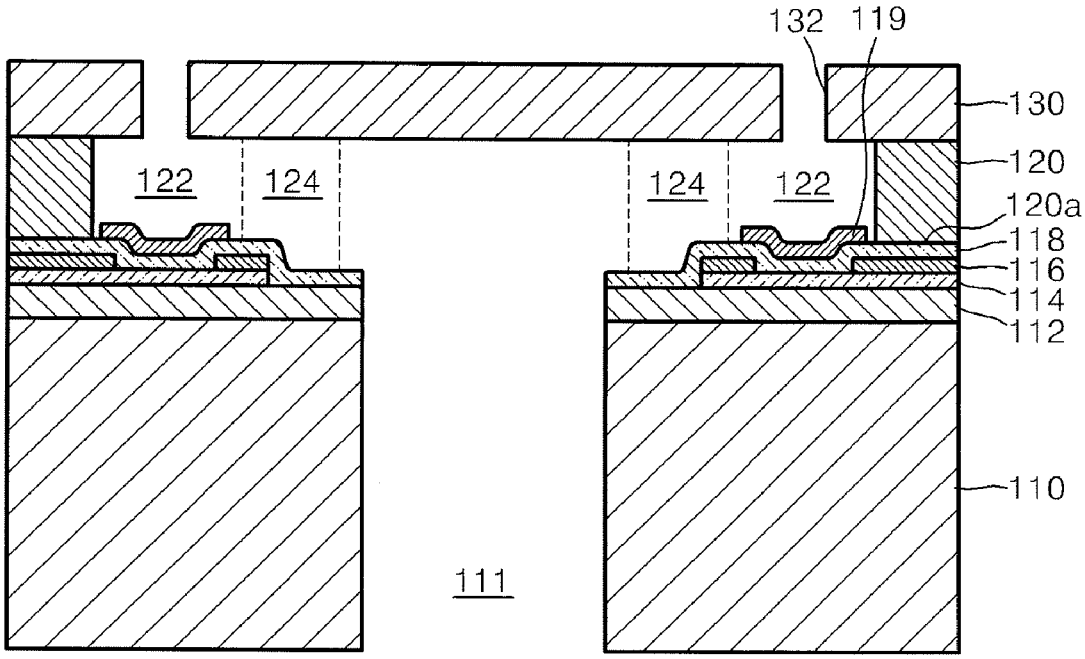
FIG. 2 is a cross-sectional view illustrating the thermal inkjet printhead taken along line II-II' of FIG. 1.

FIG. 1 is a schematic plan view illustrating of a thermal inkjet printhead according to an embodiment of the present general inventive concept, and FIG. 2 is a cross-sectional view illustrating the thermal inkjet printhead taken along line II-II' of FIG. 1.

Referring to FIGS. 1 and 2, the inkjet printhead according to the present embodiment includes a substrate 110, on which a plurality of material layers are formed, a chamber layer 120 formed on the substrate 110, and a nozzle layer 130 formed on the chamber layer 120. The substrate 110 can be a silicon substrate. The substrate 110 includes an ink feed hole 111 to supply ink. In the present embodiment, at least one of the chamber layer 120 and the nozzle layer 130 is formed of an imide silicone resin.

The material layers formed on the substrate 110 include an insulating layer 112, heaters 114, electrodes 116, and passivation layers 118 that are sequentially formed on the substrate 110. In more detail, the insulating layer 112 is formed on an upper surface of the substrate 110 in order to insulate the heaters 114 from the substrate 110. The insulating layer 112 can be formed of, for example, a silicon oxide. In addition, the heaters 114 are formed on an upper surface of the insulating layer 112 to heat the ink in corresponding ones of the ink chambers 122 to generate bubbles. The heater 114 can be formed of a heating resistive material, for example, an alloy of tantalum-aluminum, tantalum nitride, titanium nitride, or tungsten silicide. In addition, the electrodes 116 to supply electric currents to corresponding ones of the heaters 114 are formed on corresponding upper surfaces of the heaters 114. The electrode 116 can be formed of a material having a high electric conductivity, for example, Al, Al alloy, Au, or Ag.

The passivation layer 118 can be further formed on corresponding upper surfaces of the heaters 114 and the electrodes 116. The passivation layer 118 protects the heaters 114 and the electrodes 116 from being oxidized or being corroded due to contact with the ink. The passivation layer 118 can be formed of, for example, silicon nitride or silicon oxide. In addition, an anti-cavitation layer 119 can be formed on the passivation layer 118 to form a portion of a bottom of the ink chamber 122, that is, on the passivation layer 118 located above the heaters 114. The anti-cavitation layer 119 protects the heaters 114 from a cavitation force that is generated when the bubbles collapse. The anti-cavitation layer 119 can be formed of Ta, for example.

The chamber layer 120 is formed on the plurality of material layers formed on the substrate 110. The chamber layer 120 may be formed on the passivation layer 118 and may include a plurality of ink chambers 122, in which the ink that is supplied from the ink feed hole 111 to be ejected is filled. The ink chambers 122 can be formed on corresponding upper portions of the heaters 114. In addition, the chamber layer 120 can further include a plurality of restrictors 124 that are passages to connect the ink feed hole 111 to corresponding ones of the ink chambers 122. In the present embodiment, the chamber layer 120 can be formed of the imide silicone resin that is a compound material of polyimide and silicon. An example of the imide silicone resin may be an imide silicone resin disclosed by Shin-Etsu Chemical Co., Ltd., in U.S. Pat. No. 7,256,248. The imide silicone resin may have the following structural formula.

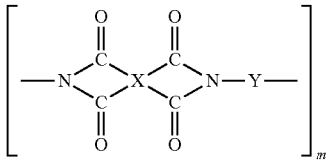

-continued

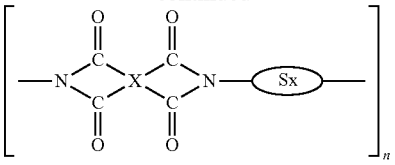

The imide silicone resin is a photosensitive material that can be patterned by a photolithography process. Therefore, when the imide silicone resin is patterned to have a predetermined shape, a fine three-dimensional structure such as the chamber layer 120 can be fabricated. In addition, the imide silicone resin rarely contracts even when it is thermally cured approximately at a temperature of 300° C. or lower, and has a superior chemical durability against the ink. Therefore, when the chamber layer 120 is formed using the imide silicone resin, the chamber layer 120 having a desired shape can be obtained, and thus, ejecting properties of the inkjet printhead can be improved. In addition, chemical durability of the chamber layer 120 against the ink increases, and thus, a lifespan of the inkjet printhead can be increased. Here, a thickness of the chamber layer 120 can range from 10 to 25 μm, however, it is not limited thereto.

A glue layer 120*a* can be further formed between the substrate 110 formed with the plurality of material layers, and the chamber layer 120. Here, the glue layer 120*a* is to increase an adhesive force between the chamber layer 120 and the substrate 110. In the present embodiment, the glue layer 120*a* can be formed of the imide silicone resin that is used to form the chamber layer 120. In addition, a thickness of the glue layer can range from 2 to 4 μm.

The nozzle layer 130 is formed on the chamber layer 120. The nozzle layer 130 includes a plurality of nozzles 132 to eject the ink, which communicate with the ink chambers 122. Here, the nozzles 132 can be located on corresponding upper portions of the ink chambers 122. The nozzle layer 130 can be formed of the imide silicone resin that is used to form the chamber layer 120. A thickness of the nozzle layer 130 can range about from 10 to 20 μm, however, it is not limited thereto.

As described above, in the thermal inkjet printhead according to the embodiment of the present general inventive concept, the chamber layer 120 and the nozzle layer 130 are formed of the imide silicone resin that is used to form the chamber layer and the nozzle layer having desired shapes, and accordingly, ink ejecting properties of the inkjet printhead can be improved. In addition, the imide silicone resin is a material having high chemical durability against the ink, and thus, the lifespan of the inkjet printhead can be increased when the chamber layer 120 and the nozzle layer 130 are formed of the imide silicone resin.

Hereinafter, a method of manufacturing an inkjet printhead according to the embodiment of the present general inventive concept will be described. FIGS. 3 through 8 are diagrams illustrating the method of manufacturing the inkjet printhead of FIG. 2.

Figure 3:
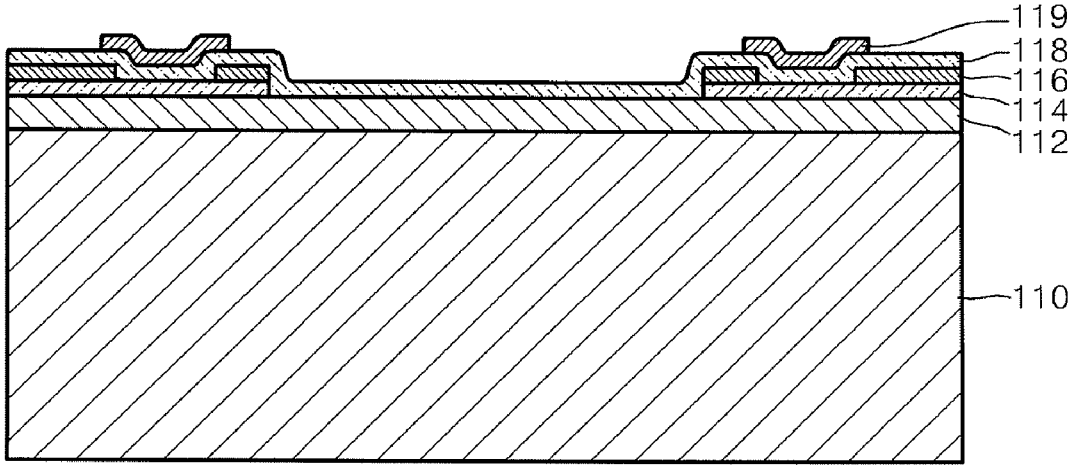
FIGS. 3 through 8 are diagrams illustrating a method of manufacturing the inkjet printhead shown in FIG. 2 according to an embodiment of the present general inventive concept.

Referring to FIGS. 2 and 3, the substrate 110 is prepared, and then, a plurality of material layers are formed on the substrate 110. The substrate 110 can be a silicon substrate. Here, the plurality of material layers can include the insulating layer 112, the heaters 114, the electrodes 116, and the passivation layer 118, which are sequentially formed on the substrate 110. The insulating layer 112 is formed on the upper surface of the substrate 110. The insulating layer 112 can insulate the heaters 114 from the substrate 110, and can be formed of, for example, a silicon oxide. In addition, the heaters 114 to heat the ink to generate the bubbles are formed on the upper surface of the insulating layer 112. The heaters 114 can be formed by depositing the heating resistive material such as an alloy of tantalum-aluminum, tantalum nitride, titanium nitride, or tungsten silicide, and then, patterning the deposited material. In addition, the electrodes 116 to supply electric current to the corresponding heaters 114 are formed on the upper portions of the heaters 114. The electrodes 116 can be formed by depositing a metal having a high electric conductivity, for example, Al, Al alloy, Ag, orAu, on upper surfaces of the heaters 114, and then, patterning the deposited metal.

In addition, the passivation layer 118 is formed on the insulating layer 112 so as to cover the heaters 114 and the electrodes 116. The passivation layer 118 protects the heaters 114 and the electrodes 116 from being oxidized or being corroded due to contact with the ink, and can be formed of, for example, silicon nitride or silicon oxide. In addition, the anti-cavitation layer 119 can be formed on the passivation layer 118. The anti-cavitation layer 119 protects the heaters 114 from a cavitation force that is generated when the bubbles collapse, and can be formed of, for example, Ta.

Figure 4:
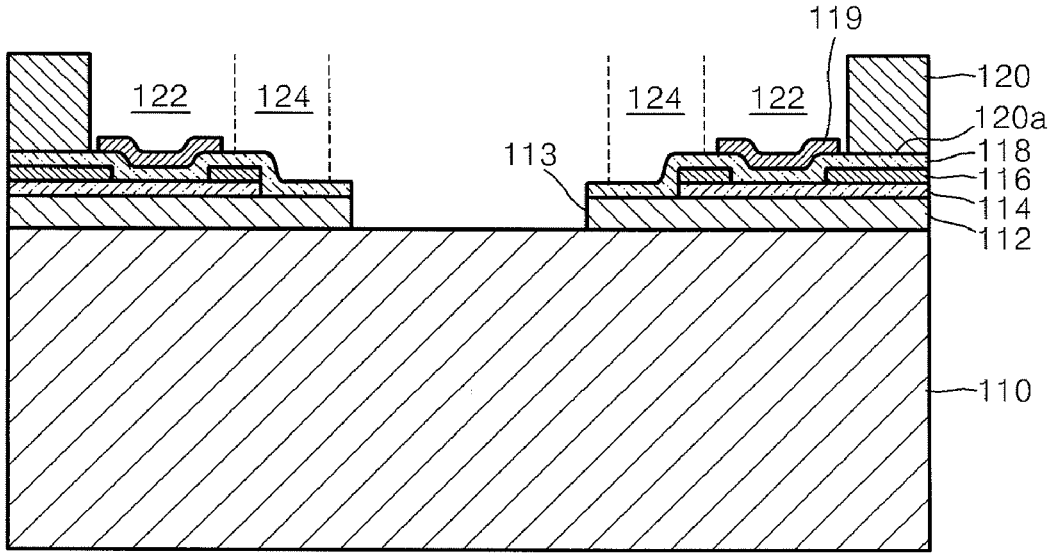

Referring to FIG. 4, the chamber layer 120 is formed on the substrate 110 formed with the plurality of material layers to define the plurality of ink chambers 122. Here, the chamber layer 120 can be formed of the imide silicone resin that is a photosensitive material, as described above. The imide silicone resin is described in the previous embodiment, and thus, detailed descriptions for the imide silicone resin will be omitted.

The chamber layer 120 can be formed as follows. A liquid imide silicone resin is applied on the structure shown in FIG. 3, and then, is dried. The liquid imide silicone resin can have a viscosity of about 800 to 1600 centi-poise. In addition, the dried imide silicone resin is patterned using the photolithography process to form the plurality of ink chambers 122. In this process, the plurality of restrictors 124 to connect the ink chambers 122 to the ink feed hole 111 (refer to FIG. 8) can be further formed. Next, the patterned imide silicone resin is thermally cured at a predetermined temperature to form the chamber layer 120. Here, a thermal curing process can be formed at a temperature of about 300° C. or lower. In this process, a volume of the imide silicone resin rarely changes, and thus, the chamber layer 120 of a desired shape having the ink chambers 122 can be formed. The chamber layers 120 can have a thickness of about 10 to 25 μm. In addition, since the imide silicone resin has a high chemical durability against ink, the durability of the chamber layer 120 can be improved.

As illustrated in FIG. 4, before forming the chamber layer 120, a process of forming the glue layer 120*a* on the substrate 110 formed with the plurality of material layers can be further performed. Here, the glue layer 120*a* is formed to increase an adhesive force between the chamber layer 120 and the substrate 110, and can be formed of the imide silicone resin that is used to form the chamber layer 120. The glue layer 120*a* can be formed by applying and drying the liquid imide silicone resin on the structure of FIG. 3, patterning the imde silicone resin, and thermally curing the patterned imde silicone resin, like the chamber layer 120. Here, the glue layer can be formed to have a thickness of about 2 to 4 μm. Next, after forming the chamber layer 120, the passivation layer 118 and the insulating layer 112 are sequentially etched to form a trench 113 that exposes the upper surface of the substrate 110. Here, the trench 113 can be formed on the upper portion of the ink feed hole 111 that will be described later.

Figure 5:
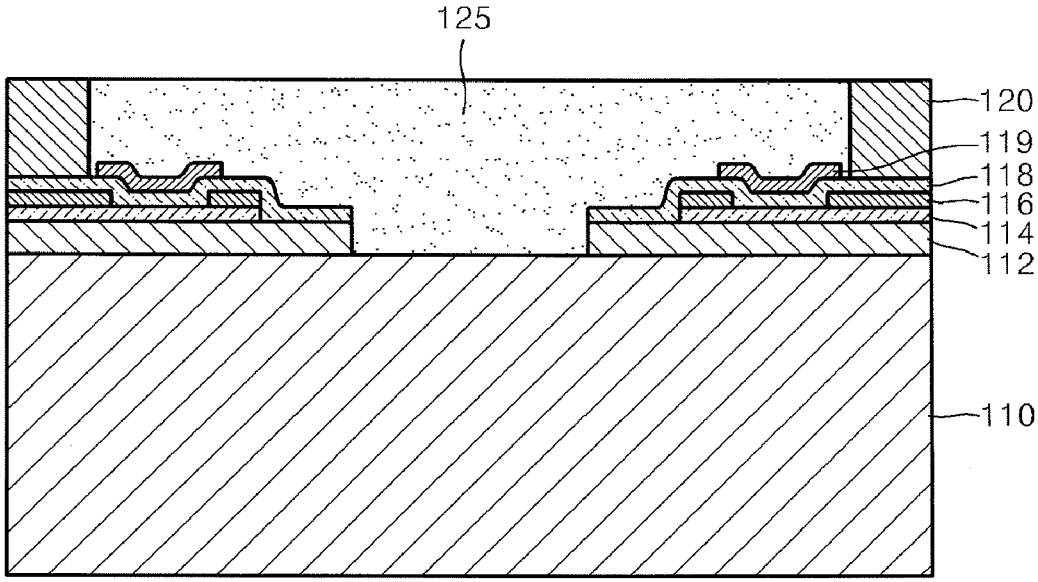

Referring to FIG. 5, a sacrificial layer 125 is formed to fill the ink chambers 122, the restrictors 124, and the trench 113. In addition, a process of flattening the upper surfaces of the sacrificial layer 125 and the chamber layer 120 using a chemical mechanical polishing (CMP) can be further performed. The chamber layer 120 can be formed to have a desired height by using the flattening process.

Figure 6:
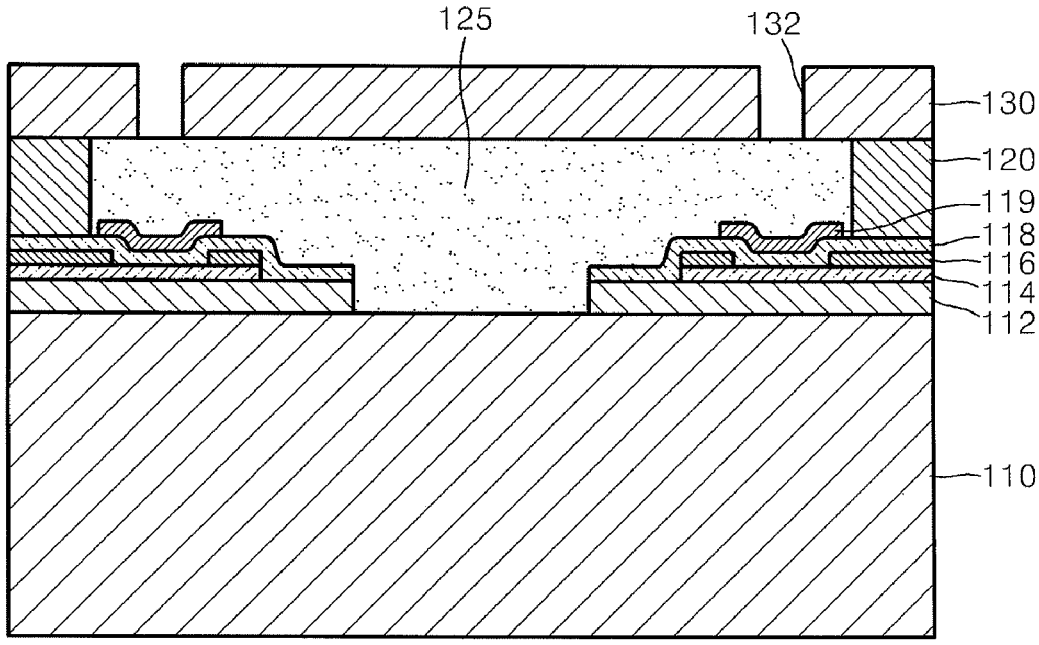

Referring to FIG. 6, the nozzle layer 130 having the plurality of nozzles 132 is formed on the upper surfaces of the chamber layer 120 and the sacrificial layer 125. Here, the nozzle layer 130 can also be formed of the imide silicone resin like the chamber layer 120. The process of forming the nozzle layer 130 is the same as the process of forming the chamber layer 120. That is, the liquid imide silicone resin is applied on the upper surfaces of the chamber layer 120 and the sacrificial layer 125, and then, is dried. The liquid imide silicone resin that is used to form the nozzle layer 130 can have a viscosity of about 800 to 1600 centi-poise. In addition, the dried imide silicone resin is patterned by a photolithography process to form the plurality of nozzles 132. The upper surface of the sacrificial layer 125 that is filled in the ink chambers 122 is exposed by the nozzles 132. Next, the patterned imide silicone resin is thermally cured at a temperature of about or lower than 300° C. to form the nozzle layer 130. In this process, since the volume of the imide silicone resin rarely changes during the thermal curing, the nozzle layer 130 having the nozzles 132 of desired shapes can be formed. The nozzle layer 130 can have a thickness of about 10 to 20 μm. In addition, since the imide silicone resin has the high chemical durability against the ink, the durability of the nozzle layer 130 can be improved.

Figure 7:
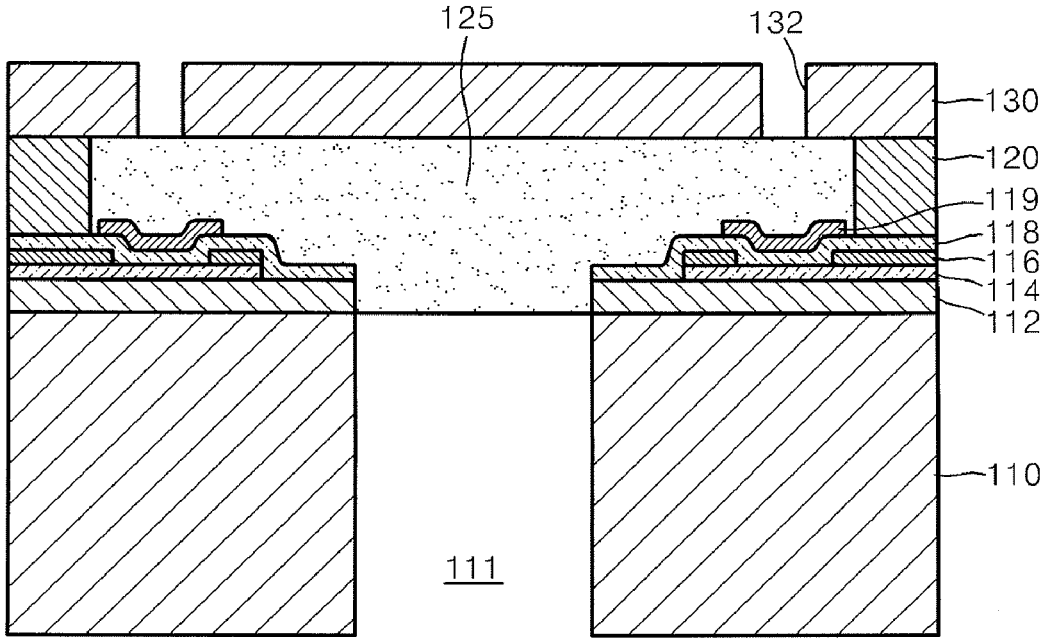
Figure 8:
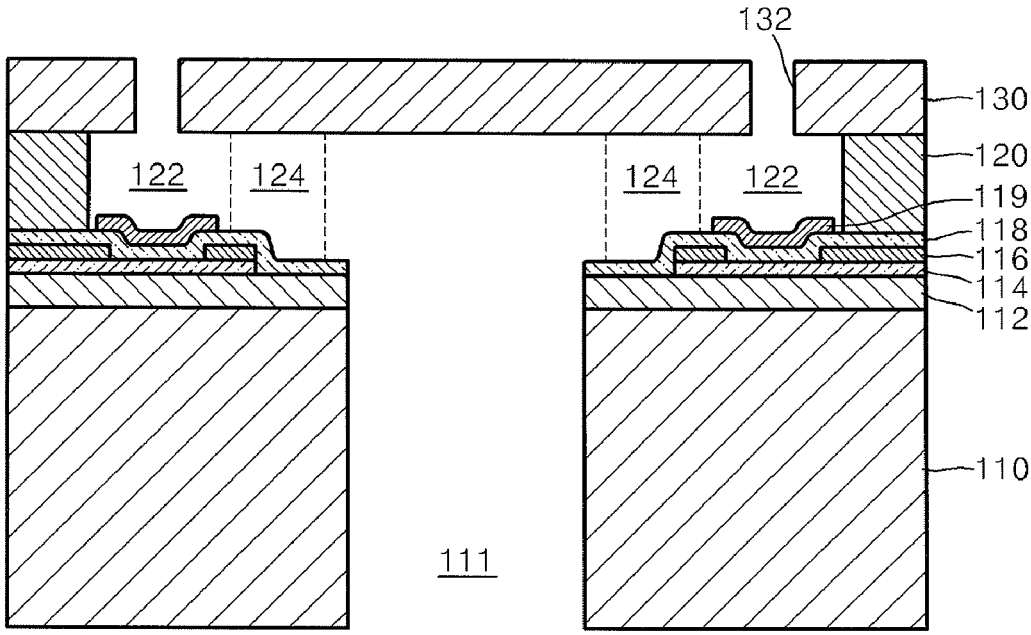

Referring to FIG. 7, the ink feed hole 111 for supplying the ink is formed in the substrate 110. The ink feed hole 111 can be formed by etching a lower surface of the substrate 110 until a lower surface of the sacrificial layer 125 filled in the trench 113 is exposed. In addition, referring to FIG. 8, an etchant that can selectively etch the sacrificial layer 125 is injected through the ink feed hole 111 and the sacrificial layer 125. Accordingly, the sacrificial layer 125 filled in the ink chambers 122, the restrictors 124, and the trench 125 can be removed, and then, formation of the inkjet printhead of the embodiment of the present general inventive concept is completed.

In the above description, the chamber layer 120 and the nozzle layer 130 are both formed of the imide silicone resin, however, only one of the chamber layer 120 and the nozzle layer 130 can be formed of the imide silicone resin according to the present general inventive concept. The other one of the chamber layer 120 and the nozzle layer 130 can be formed of a material different from the imide silicone resin.

Figure 9:
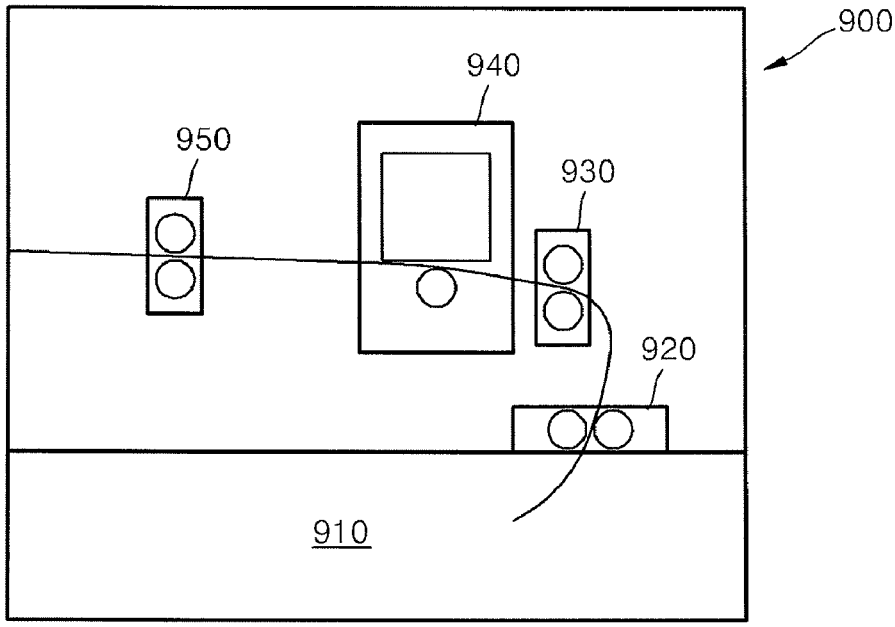
FIG. 9 is a view illustrating an image forming apparatus according to an embodiment of the present general inventive concept.

As illustrated in FIG. 9, an image forming apparatus 900 may use the above-described inkjet printhead to eject ink so that a predetermined image is formed on a printing medium. The image forming apparatus 900 may include a cassette 910, a pickup unit to pick-up a printing medium from the cassette 910, a feeding unit 930 to feed the picked-up printing medium along a feeding path, a printing unit having the above-described inkjet printhead to eject ink to print on the fed printing image, a discharge unit to discharge the printing medium, and a controller to control components of the image forming apparatus 900. It is possible that the printing medium is stationary, and the printing unit is movable with respect to the printing medium to print. It is also possible that the inkjet printhead of the printing unit may be a shuttle type inkjet printhead or an array type inkjet printhead. The inkjet printhead may be a mono inkjet printhead to eject a black ink or a color inkjet printhead to eject ink of different colors.

As described above, in the inkjet printhead according to the present invention, the chamber layer and/or the nozzle layer are formed of the imide silicone resin that is a photosensitive material, and thus, a volume contraction that is caused by the thermal curing process can be greatly reduced. Therefore, the chamber layer or the nozzle layer having a desired shape can be formed. Accordingly, ink ejecting properties of the inkjet printhead can be improved. In addition, since the imide silicone resin has superior chemical durability against the ink, the lifespan of the inkjet printhead can also be increased.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead comprising:

a substrate formed with a plurality of heaters to heat ink to generate ink bubbles;

a chamber layer formed on the substrate to define a plurality of ink chambers; and a nozzle layer formed on the chamber layer to define a plurality of nozzles, wherein at least one of the chamber layer and the nozzle layer has a three-dimensional structure with a thickness of about or higher than 10 μm, and is formed entirely of an imide silicone resin to have a high chemical durability against ink and to prevent a volume change in response to heat.

2. The inkjet printhead of claim 1, further comprising:

a glue layer formed between the substrate and the chamber layer.

3. The inkjet printhead of claim 2, wherein the glue layer is formed of the imide silicone resin.

4. The inkjet printhead of claim 1, wherein the chamber layer has a thickness of 10 to 25 μm.

5. The inkjet printhead of claim 1, wherein the nozzle layer has a thickness of 10 to 20 μm.

6. The inkjet printhead of claim 1, wherein the substrate includes an ink feed hole that penetrates through the substrate to supply the ink to the ink chambers.

7. The inkjet printhead of claim 1, wherein an insulating layer, the heaters, electrodes to supply electric current to the heaters, and a passivation layer to protect the heaters and the electrodes are sequentially formed on the substrate.

8. The inkjet printhead of claim 7, further comprising:

an anti-cavitation layer formed on the passivation layer to protect the heaters from a cavitation pressure that is generated when bubbles collapse.

9. The inkjet printhead of claim 1, wherein the imide silicone resin is a dried liquid imide silicone resin, the liquid imide silicone resin having a viscosity of about 800 to about 1600 centipoise.

10. An image forming apparatus comprising:

a feeding unit to feed a printing medium;

a printing unit to print the printing medium, and having an inkjet printhead comprising:

a substrate formed with a plurality of heaters to heat ink to generate ink bubbles, a chamber layer formed on the substrate to define a plurality of ink chambers, and a nozzle layer formed on the chamber layer to define a plurality of nozzles, wherein at least one of the chamber layer and the nozzle layer has a three-dimensional structure with a thickness of about or higher than 10 μm and is formed entirely of an imide silicone resin to have a high chemical durability against ink and to prevent a volume change in response to heat; and a discharge unit to discharge the printing medium.

11. An inkjet printhead comprising:

a substrate formed with a plurality of heaters to heat ink to generate ink bubbles;

a chamber layer formed on the substrate to define a plurality of ink chambers;

a nozzle layer formed on the chamber layer to define a plurality of nozzles; and a glue layer formed between the substrate and the chamber layer and made of an imide silicone resin, at least one of the chamber layer and the nozzle layer having a three-dimensional structure with a thickness of about or higher than 10 μm, and being formed entirely of an imide silicone resin to have a high chemical durability against ink and to prevent a volume change in response to heat.

12. An inkjet printhead comprising:

a substrate formed with a plurality of heaters to heat ink to generate ink bubbles;

a chamber layer formed on the substrate, having a three-dimensional structure with a thickness of about or higher than 10 μm and made entirely of a first imide silicone resin to define a plurality of ink chambers;

a nozzle layer formed on the chamber layer, having a three-dimensional structure with a thickness of about or higher than 10 μm and made entirely of a second imide silicone resin to define a plurality of nozzles; and a glue layer formed between the substrate and the chamber layer and made of a third imide silicone resin, the first imide silicone resin and the second imide silicone resin to have a high chemical durability against ink and to prevent a volume change in response to heat.

* * * * *